United States Patent [19]

Melchior

[11] Patent Number: 4,625,661

[45] Date of Patent: Dec. 2, 1986

[54] HAZARDOUS WASTE INCINERATOR

[75] Inventor: August S. Melchior, Wilson, N.C.

[73] Assignee: Melchior-Moore Associates, Inc., Wilson, N.C.

[21] Appl. No.: 815,628

[22] Filed: Jan. 2, 1986

[51] Int. Cl.[4] ..... F23D 3/00; F23D 5/00; F23D 7/00; F23D 9/00

[52] U.S. Cl. ..... 110/241; 110/237; 110/238; 110/215

[58] Field of Search ..... 110/237, 238, 241, 235, 110/346, 215

[56] References Cited

U.S. PATENT DOCUMENTS 1,326,414 12/1919 Quinn et al. ..... 110/237 X
4,481,891 11/1984 Takeshita et al. ..... 110/238
4,579,069 4/1986 Gay et al. ..... 110/237 X

*Primary Examiner*—Edward G. Favors
*Attorney, Agent, or Firm*—Bell, Seltzer, Park & Gibson

[57] ABSTRACT

The present portable incinerator is adapted for the disposal of small amounts of hazardous waste material with a minimum of exhaust combustion gas and includes a boiling chamber for receiving and heating the hazardous waste material to form waste gas thereof. The waste gas is directed through successive primary and secondary combustion chambers which are supplied with pure oxygen and the mixture of waste gas and oxygen is ignited for oxidizing the mixture, and for ionizing the gases to combine with the oxygen. A catalytic converter is positioned at the exit ends of each of the primary and secondary combustion chambers and the oxidized and ionized combustion gas passes through these catalytic converters to insure total oxidation thereof. A vertical wet scrubber chamber is communicatively connected with the exit end of the secondary combustion chamber and the combustion gas is directed to pass upwardly therethrough to prevent harmful combustion gases from escaping through the exhaust.

18 Claims, 1 Drawing Figure

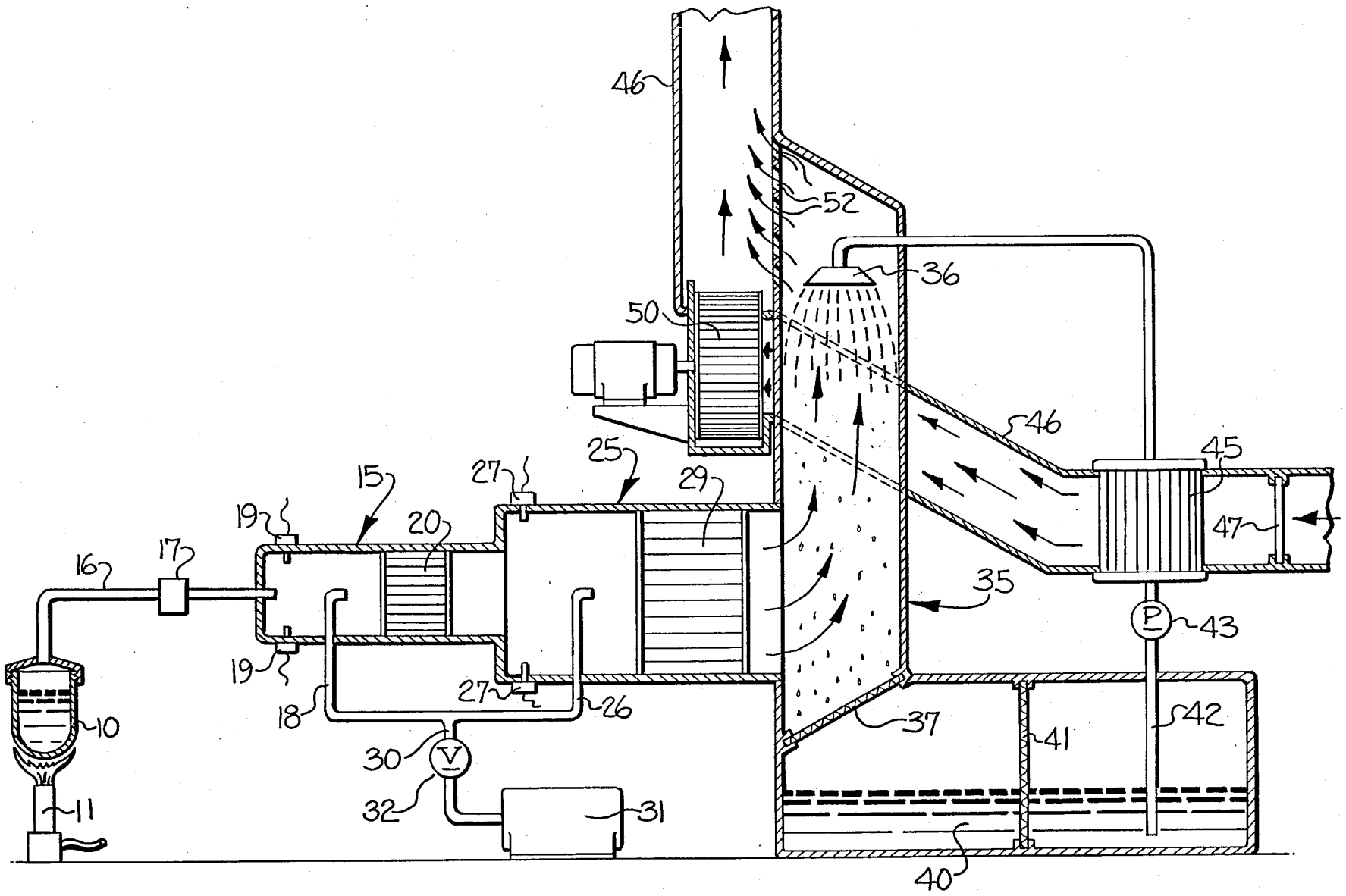
45
47
43
P
42
41
46
35
36
37
40
52
29
50
46
25
26
31
27
27
V
20
30
32
15
18
19
19
17
16
10
11

HAZARDOUS WASTE INCINERATOR

FIELD OF THE INVENTION

This invention relates generally to a portable incinerator for the disposal of small amounts of hazardous waste material in a non-solid and fluent state, and more particularly to such an incinerator wherein a boiling chamber is provided for vaporizing the hazardous waste material, a combustion chamber provides total oxidation of the vaporized waste gas, and a wet scrubber prevents the escape of harmful combustion gases through the exhaust.

BACKGROUND OF THE INVENTION

It is known to provide various types of incinerators for the disposal of hazardous waste materials. These known types of incinerators are usually large and expensive to construct and operate. Because of their size and expense, these large incinerators are adapted to process large quantities of hazardous waste material and this requires that the waste material be collected from many widely separated industrial plants and then trucked over considerable distances to the large incinerator facility. In many instances, large incinerators of this type do not completely dispose of the waste material and permit the emission of harmful combustion gases into the atmosphere at a level which would not be permitted under strictly enforced air pollution emission standards currently established by federal, state and local agencies. Also, the transportation of the hazardous waste materials to the incinerator is expensive and occasionally results in the accidental spill of the hazardous waste material into the environment.

SUMMARY OF THE INVENTION

With the foregoing in mind, it is an object of the present invention to provide a small portable hazardous waste incinerator which is inexpensive to manufacture and may be easily moved to the location where the hazardous waste material is produced so that the hazardous waste material may be disposed of in an economical manner and with a minimum of exhaust combustion gases.

The portable incinerator of the present invention includes a boiling chamber for receiving small amounts of the hazardous waste material therein and for heating and vaporizing the hazardous waste material to form waste gas thereof. A primary combustion chamber is spaced from the boiling chamber and the vaporized waste gas is conducted from the boiling chamber into the entrance end of the primary combustion chamber. Electric arcs are positioned in the entrance end of the primary combustion chamber for igniting and ionizing the mixture of gas and oxygen. A catalytic converter is positioned at the exit end of the primary combustion chamber and the oxidized waste gas passes through the catalytic converter for obtaining total oxidation of the combustion gases.

It is preferred that a secondary combustion chamber be provided for insuring complete oxidation of the waste gas. A vertical wet scrubber chamber is communicatively connected to the exit end of the secondary combustion chamber and the combustion gases are directed into and pass upwardly therethrough, to be exhausted at the upper end thereof. The wet scrubber chamber prevents harmful combustion waste gas from escaping through the exhaust.

BRIEF DESCRIPTION OF THE DRAWING

Other objects and advantages will appear as the description proceeds when taken in connection with the accompanying drawing in which the single figure is a schematic diagram of the incinerator of the present invention and showing the flow of the hazardous waste material therethrough.

DESCRIPTION OF THE ILLUSTRATED EMBODIMENT

As shown in the drawing, a boiling chamber 10 is provided for receiving small amounts of the hazardous waste material, such as for example about sixteen ounces, in a sealed condition therein. Heating means, illustrated in the form of a gas burner 11, is provided for heating and vaporizing the hazardous waste material to form waste gas thereof. Means is provided for conducting the vaporized waste gas from the upper end of the boiling chamber and into the entrance end of a primary combustion chamber, broadly indicated at 15. The vaporized waste gas conducting means is illustrated as a duct 16 extending between the upper end of the boiling chamber 10 and the entrance end of the primary combustion chamber 15. A check valve 17 is provided in the duct 16 for preventing backflow of the vaporized waste gas. Oxygen supply means, in the form of a branch supply line 18, is provided for injecting pure oxygen into the primary combustion chamber 15.

Igniting means, in the form of electric arcs 19, is positioned in the entrance end of the primary combustion chamber 15 for igniting the mixture of waste gas and pure oxygen in the primary combustion chamber 15, and for ionizing the gases to combine with the oxygen. A catalytic converter 20 is positioned adjacent the exit end of the primary combustion chamber 15 and through which the oxidized waste gas passes for obtaining total oxidation of the combustion gas leaving the primary combustion chamber 15. The catalytic converter 20 produces a catalytic reaction and assures complete combustion and oxidation of the combustion gas as it passes out of the exit end of the primary combustion chamber.

A secondary combustion chamber, broadly indicated at 25, is communicatively connected to the exit end of the primary combustion chamber 15 and pure oxygen is supplied thereto through a branch supply line 26. Ignition means, in the form of electric arcs 27, is positioned in the entrance end of the secondary combustion chamber 25 for igniting the mixture of waste gas and oxygen. A catalytic converter 29 is positioned at the exit end of the secondary combustion chamber 25 and through which the oxidized waste gas passes for insuring total combustion and oxidation of the combustion gas as it is discharged from the exit end of the secondary combustion chamber 25. The oxygen branch supply lines 18 and 26 are connected to one end of a main supply line 30, which is connected at its other end to a suitable source of pure oxygen, indicated as an oxygen supply tank 31. A control valve 32 is provided in the main supply line 30 for controlling the flow of oxygen to the primary and secondary combustion chambers 15, 25.

The waste gas is discharged from the exit end of the secondary combustion chamber 25 and into a vertical wet scrubber chamber, broadly indicated at 35, communicatively connected to the exit end of the secondary combustion chamber 25. The combustion gas passes upwardly through the wet scrubber 35 and is exhausted at the upper end thereof, in a manner to be presently described. The upper end portion of the wet scrubber chamber 35 is provided with a mister head 36 to dispense a suitable scrubber solution downwardly through the upwardly flowing combustion gas and to prevent the escape of any harmful combustion gas through the exhaust.

The scrubber solution falls downwardly through the vertical wet scrubber chamber 35 and engages and passes through a filter 37 for the scrubber solution before it is deposited in a holding tank 40. The filter 37 filters the scrubber solution and provides a wetted surface to allow combustion products to combine with the scrubber solution before the scrubber solution is deposited in the holding tank 40. The medial portion of the scrubber tank is provided with a vertically disposed filter 41 for dividing the holding tank into a holding area and a scrubber solution supply area. The filter 41 acts to filter any precipitant that might form in the scrubber solution and prevents the same from being passed into the supply area of the holding tank 40.

The lower end of a scrubber solution supply line 42 is positioned in the scrubber solution in the supply area of the holding tank 40 and the upper end is connected to the mister head 36. A scrubber solution supply pump 43 is interposed in the supply line 42 for pumping the scrubber solution from the holding tank 40 and through the mister head 36 at the upper end of the vertical wet scrubber chamber 35. A heat exchanger 45 is provided in the scrubber solution supply line 42 and in a cool air entrance duct 46. A filter 47 is provided in the entrance end of the cool air duct 46 for filtering the incoming air passing over the heat exchanger 45.

The cool air duct 46 extends upwardly beside and adjacent the upper end portion of the wet scrubber chamber 35. Cool air is directed through the duct 46 by a blower 50 and exhausted out of the upper end thereof. Openings 52 are provided in the upper end portion of the wet scrubber chamber 35 so that the combustion gas is drawn out of the upper end portion of the vertical wet scrubber chamber 35 and into the exhaust air duct 46. The scrubber solution is heated as it falls downwardly through the upwardly directed combustion gas passing upwardly through the wet scrubber chamber 35 so that the scrubber solution is heated. As the scrubber solution is withdrawn from the holding tank 40 and passes through the heat exchanger 45, it is cooled by the incoming cool air before it is again dispensed through the mister heat 36.

METHOD OF OPERATION

A small amount of hazardous waste material to be disposed of is placed in the boiling chamber 10 and sealed therein. The heating gas burner 10 is then operated to vaporize the hazardous waste material so that the waste gas passes upwardly therefrom and through the duct 16 and into the primary combustion chamber 15. The waste gas is mixed with the pure oxygen inserted therein by the supply line 18 and ignited by the electric arcs 19 for oxidizing the mixture of waste gas and oxygen, and for ionizing the gases to combine with the oxygen. The combustion gas then passes through the catalytic converter 20 into the secondary combustion chamber 25. In the secondary combustion chamber 25, the combustion gas is again combined with pure oxygen and ignited and then passes through the catalytic converter 29 to insure total oxidation of the combustion gas and to provide a minimum of waste material in the exhaust combustion gas as it passes upwardly through the wet scrubber chamber 35. The scrubber solution is directed downwardly in the wet scrubber chamber 35 from the mister heat 36 to prevent escape of harmful combustion gas from the upper end of the exhaust duct 46. The scrubber solution passes through the filters 37 and 41 before it is again pumped upwardly through the heat exchanger 45 and dispensed by the mister head 36. The upwardly directed cool air is drawn inwardly over the heat exchanger 45 and creates a low pressure in the upper end of the wet scrubber chamber 35 to draw the combustion gas out of the wet scrubber chamber 35 and direct the same outwardly through the exhaust.

The present portable incinerator is adapted for the disposal of small amounts of various types of hazardous waste material in a fluent or flowing state. The hazardous waste material to be incinerated may be in a fluid, liquid or aqueous condition. The hazardous waste material may also be in a semi-fluid, semi-liquid or semi-aqueous condition and is disposed of with a minimum of exhaust combustion gases.

As a specific but nonlimiting example, the present incinerator may be used for the disposal of carbon tetrachloride wherein the reaction in the combustion chambers 15, 25 is as follows:

$$CCl_4 + O_2 \xrightarrow{\Delta} CO_2\uparrow + 2Cl_2\uparrow$$

Thus, the carbon tetrachloride combined with pure oxygen is oxidized to produce carbon dioxide and chlorine gas. In this example, the scrubber solution is sodium hydroxide so that the chlorine gas exhausted into the wet scrubbing chamber 35 is rendered harmless in a reaction wherein the chlorine gas and the sodium hydroxide and water yields sodium chloride and water (salt water) and no harmful combustion gas is discharged through the exhaust.

In the drawing and specification there has been set forth the best mode presently contemplated for the practice of the present invention and although specific terms are employed, they are used in a generic and descriptive sense only and not for purposes of limitation, the scope of the invention being defined in the claims.

That which is claimed is:

1. A portable incinerator for the disposal of small amounts of hazardous waste material with a minimum of exhaust combustion gases and comprising the combination of a boiling chamber for receiving the hazardous waste material therein, heating means cooperating with the boiling chamber for vaporizing the hazardous waste material therein to form waste gas thereof, a combustion chamber spaced from said boiling chamber, means for conducting the vaporized waste gas from said boiling chamber and into the entrance end of said combustion chamber, oxygen supply means for injecting oxygen into said combustion chamber, ignition means positioned in said combustion chamber for igniting the mixture of waste gas and oxygen, a catalytic converter positioned at the exit end of said combustion chamber and through which the oxidized waste gas passes for obtaining total oxidation of the combustion gas, and a wet scrubber chamber communicatively connected to the exit end of said combustion chamber and into which the combustion gases are directed to pass therethrough and to be exhausted at the opposite end thereof, said wet scrubber chamber preventing harmful combustion gases from escaping through the exhaust.

2. A portable incinerator according to claim 1 wherein said heating means comprises a gas burner for heating said boiling chamber and vaporizing the hazardous material therein.

3. A portable incinerator according to claim 1 wherein said ignition means comprises an electric arc.

4. A portable incinerator according to claim 1 including a secondary combustion chamber communicatively connected to the exit end of said combustion chamber, oxygen supply means for injecting oxygen into said secondary combustion chamber, ignition means positioned in said secondary combustion chamber for igniting the mixture of waste gas and oxygen, and a catalytic converter positioned at the exit end of said secondary combustion chamber and through which the oxidized waste gas passes for obtaining total oxidation of the combustion gas.

5. A portable incinerator according to claim 1 wherein said wet scrubber chamber includes a mister head positioned in an upper end portion of said vertical wet scrubber chamber for dispensing scrubber solution to pass downwardly through the moving combustion gas in said wet scrubber chamber.

6. A portable incinerator according to claim 5 including a holding tank communicatively connected with a lower end of said wet scrubber chamber for receiving the scrubber solution being deposited therein by said mister head.

7. A portable incinerator according to claim 6 including filter means at the entrance end of said holding tank for filtering the scrubber solution being deposited in said holding tank and to provide a wetted surface for permitting any combustion products to combine with the scrubber solution.

8. A portable incinerator according to claim 7 including scrubber solution circulation means for withdrawing the scrubber solution from said holding tank and directing the same through said mister head positioned in the upper portion of said vertical wet scrubber chamber.

9. A portable incinerator according to claim 8 including a heat exchanger interposed in said circulation means, and air duct means in which said heat exchanger is positioned for drawing cool air inwardly over said heat exchanger for reducing the temperature of the scrubber solution being withdrawn from said holding tank and directed through said mister head.

10. A portable incinerator according to claim 9 wherein said air duct means is communicatively connected with an upper end portion of said wet scrubber chamber and includes an upper exhaust end, said air duct means providing reduced pressure in the upper end of said vertical wet scrubber chamber for withdrawing combustion gas therefrom and exhausting the same.

11. A portable incinerator for the disposal of small amounts of hazardous waste material with a minimum of exhaust combustion gases and comprising the combination of a boiling chamber for receiving the hazardous waste material therein, heating means cooperating with the boiling chamber for vaporizing the hazardous waste material therein to form waste gas thereof, a combustion chamber spaced from said boiling chamber, means for conducting the vaporized waste gas from said boiling chamber and into the entrance end of said combustion chamber, oxygen supply means for injecting oxygen into said combustion chamber, ignition means positioned in the entrance end of said combustion chamber for igniting the mixture of waste gas and oxygen, a catalytic converter positioned at the exit end of said combustion chamber and through which the oxidized waste gas passes for obtaining total oxidation of the combustion gas, and a vertical wet scrubber chamber communicatively connected to the exit end of said combustion chamber and into which the combustion gases are directed to pass upwardly therethrough and to be exhausted at the upper end thereof, said wet scrubber chamber preventing harmful combustion gases from escaping through the exhaust, said vertical wet scrubber chamber including a mister head positioned in the upper end portion thereof for dispensing scrubber solution to pass downwardly through the upwardly moving combustion gas in said wet scrubber chamber, and a holding tank communicatively connected with the lower end of said vertical wet scrubber chamber for receiving the scrubber solution being deposited therein by said mister head.

12. A portable incinerator according to claim 11 including filter means at the entrance end of said holding tank for filtering the scrubber solution being deposited in said holding tank and to provide a wetted surface for permitting any combustion products to combine with the scrubber solution.

13. A portable incinerator according to claim 12 including scrubber solution circulation means for withdrawing the scrubber solution from said holding tank and directing the same through said mister head positioned in the upper portion of said vertical wet scrubber chamber.

14. A portable incinerator according to claim 13 including a heat exchanger interposed in said circulation means, and air duct means in which said heat exchanger is positioned for drawing cool air inwardly over said heat exchanger for reducing the temperature of the scrubber solution being withdrawn from said holding tank and directed through said mister head.

15. A portable incinerator according to claim 14 wherein said air duct means is communicatively connected with the upper end portion of said vertical wet scrubber chamber and includes an upper exhaust end, said air duct means providing reduced pressure in the upper end of said vertical wet scrubber chamber for withdrawing combustion gas therefrom and exhausting the same.

16. A portable incinerator according to claim 15 wherein said heating means comprises a gas burner for heating said boiling chamber and vaporizing the hazardous material therein.

17. A portable incinerator according to claim 16 wherein said ignition means comprises an electric arc.

18. A portable incinerator according to claim 11 including a secondary combustion chamber communicatively connected to the exit end of said combustion chamber, oxygen supply means for injecting oxygen into said secondary combustion chamber, ignition means positioned in the entrance end of said secondary combustion chamber for igniting and ionizing the mixture of waste gas and oxygen, and a catalytic converter positioned at the exit end of said secondary combustion chamber and through which the oxidized waste gas passes for obtaining total oxidation of the combustion gas.

* * * * *